US007096520B2

(12) United States Patent
Nicolia et al.

(10) Patent No.: US 7,096,520 B2
(45) Date of Patent: Aug. 29, 2006

(54) FIXTURE CARRIER

(75) Inventors: Carl R. Nicolia, Erie, PA (US); Douglas R. Wroblewski, Wattsburg, PA (US); David L. Lawson, North East, PA (US); Donald A. Kubiak, Erie, PA (US); Philip A. Falbo, Sr., Erie, PA (US)

(73) Assignee: Zurn Industries, Inc., Erie, PA (US)

( * ) Notice: Subject to any disclaimer, the term of this patent is extended or adjusted under 35 U.S.C. 154(b) by 163 days.

(21) Appl. No.: 10/811,477

(22) Filed: Mar. 26, 2004

(65) Prior Publication Data

US 2005/0211852 A1 Sep. 29, 2005

(51) Int. Cl.
*E03C 1/32* (2006.01)

(52) U.S. Cl. ..... 4/645; 248/149; 248/688

(58) Field of Classification Search ..... 4/645, 4/646, 252.1, 695; 248/148, 149, 419, 172, 248/176.3, 688, 676, 544, 916
See application file for complete search history.

(56) References Cited

U.S. PATENT DOCUMENTS

| | | | | |
|---|---|---|---|---|
| 1,078,546 | A | 11/1913 | McCarthy et al. | |
| 2,716,757 | A | 9/1955 | Eriksson | |
| 3,932,899 | A | 1/1976 | Brady et al. | |
| 4,158,898 | A | 6/1979 | Denhart | |
| 4,434,516 | A | 3/1984 | Morris et al. | |
| 4,979,239 | A | 12/1990 | Klein et al. | |
| 5,044,584 | A | 9/1991 | Lin | |
| 5,050,253 | A | 9/1991 | Wasek | |
| 5,148,552 | A | 9/1992 | Kress et al. | |
| 5,230,109 | A | 7/1993 | Zaccai et al. | |
| 5,407,171 | A * | 4/1995 | Gonzalez | 248/670 |
| 5,617,962 | A * | 4/1997 | Chen | 211/206 |
| 5,660,637 | A * | 8/1997 | Dodge | 118/500 |
| 5,724,773 | A | 3/1998 | Hall | |
| 6,360,381 | B1 | 3/2002 | Fitzgerald, Sr. | |
| 6,803,521 | B1 * | 10/2004 | Vrame | 174/58 |
| 2004/0222179 | A1 * | 11/2004 | Garcia | 211/206 |

OTHER PUBLICATIONS

One page photocopy of Labor Saver™ Fixture Support Illustration Figure Nos. 0609-0925.

* cited by examiner

*Primary Examiner*—Ramon O Ramirez
(74) *Attorney, Agent, or Firm*—The Webb Law Firm

(57) ABSTRACT

A fixture carrier including two uprights spaced apart and secured using cross bars that permit the center-to-center distance between the uprights to be adjusted. In conjunction with this horizontal adjustment, vertically adjustable support members mounted upon each upright provides a factory-assembled fixture carrier that may be easily adjusted in the field to accommodate horizontal distances between the uprights and vertical positions of the support members. Supporting arms for carrying the fixture are secured to each support member.

21 Claims, 4 Drawing Sheets

FIXTURE CARRIER

BACKGROUND OF THE INVENTION

1. Field of the Invention

This invention is directed to a fixture carrier for supporting plumbing fixtures, wherein the carrier has a frame with supporting arms and wherein the supporting arms are both vertically and horizontally adjustable.

2. Description of Related Art

Fixture carriers are utilized to act as supports for plumbing fixtures such as service sinks, lavatories (sinks), urinals and water coolers. The fixture carriers are mounted upon a floor behind a wall and arms extend from the carrier through apertures in the wall to support a fixture with as little of the carrier visible as possible. In the past, fixture carriers were delivered to a work site in parts such that each fixture carrier had to be assembled on site. Not only did this turn out to be time consuming and expensive but, furthermore, it was possible that, with the congestion of a typical work site, parts of the unassembled fixture carrier could be misplaced or lost thereby further delaying assembly of the carrier.

U.S. Pat. No. 6,360,381 is directed to a universal fixture support comprised of a rigid rectangular frame having two upright spaced-apart posts connected by two cross bars that are permanently attached to the ends of the posts. Supporting arms extend from brackets which are vertically adjustable upon each upright. However, in the arrangement disclosed in the '381 patent, the center-to-center distance between brackets secured upon each upright is fixed and, as a result, this fixture support may be utilized only for fixtures that are compatible with the fixed center-to-center distance of the brackets for this particular fixture support.

A fixture support manufactured by J. R. Smith Manufacturing Company identified as their Labor Saver™ fixture support is similar in design to the fixture support illustrated in the '381 patent with the exception that the brackets from which the supporting arms extend are slotted with bolts extending therethrough such that the brackets may be laterally moved to adjust the center-to-center distance between the brackets for accommodating fixtures having different center-to-center dimensions. However, this lateral motion forces the location of each bracket to be offset relative to the centerline of each upright and this produces an undesirable bending moment upon the bolts securing the brackets and whole system, as opposed to a bracket wherein the supporting arms are aligned with the centerline of the uprights.

Additionally, the brackets of the Labor Saver fixture support are simultaneously adjustable in the vertical direction and in the lateral direction. As a result, precise positioning of each bracket may be difficult since it is not possible to secure the bracket, for example, in a vertical position and then subsequently secure the bracket in a lateral position.

A fixture carrier is needed that is factory assembled, but when installed in the field, provides maximum flexibility in assembly and provides a high level of strength in each supporting arm.

SUMMARY OF THE INVENTION

A fixture carrier for supporting plumbing fixtures is comprised of a frame having a left upright and a right upright spaced horizontally a distance therefrom, wherein each upright has a top region and a bottom region. The frame also has a top cross bar connecting the top regions of each upright thereby defining top connections and a bottom cross bar connecting the bottom regions of each upright thereby defining bottom connections, wherein at least one top connection and at least one bottom connection are adjustable to permit adjustment of the horizontal distance between uprights. Additionally, the frame has a left face plate mounted to the left upright and a right face plate mounted to the right upright, wherein each face plate is vertically adjustable along an upright and wherein each face plate is adapted to support a plumbing fixture.

DETAILED DESCRIPTION OF THE INVENTION

Figure 1:
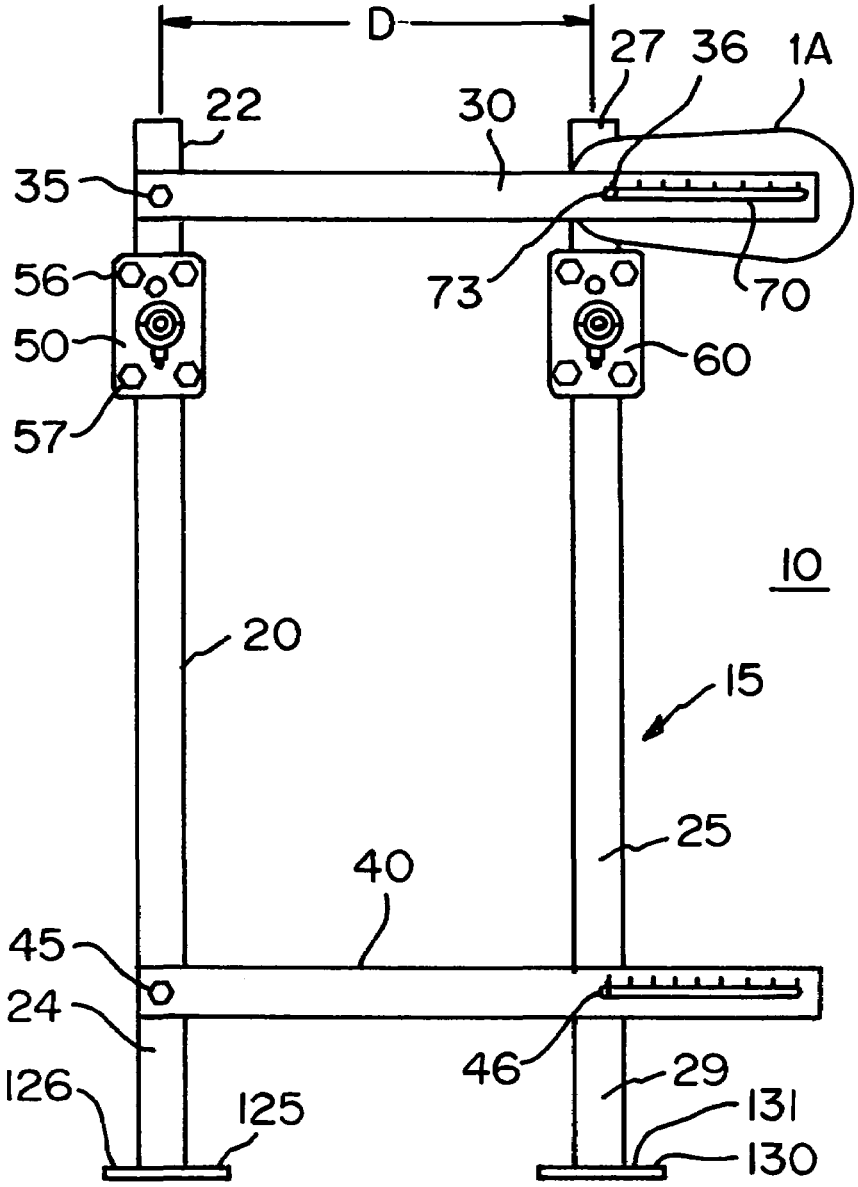
FIG. 1 is a front view of the fixture carrier in accordance with the subject invention.
Figure 2:
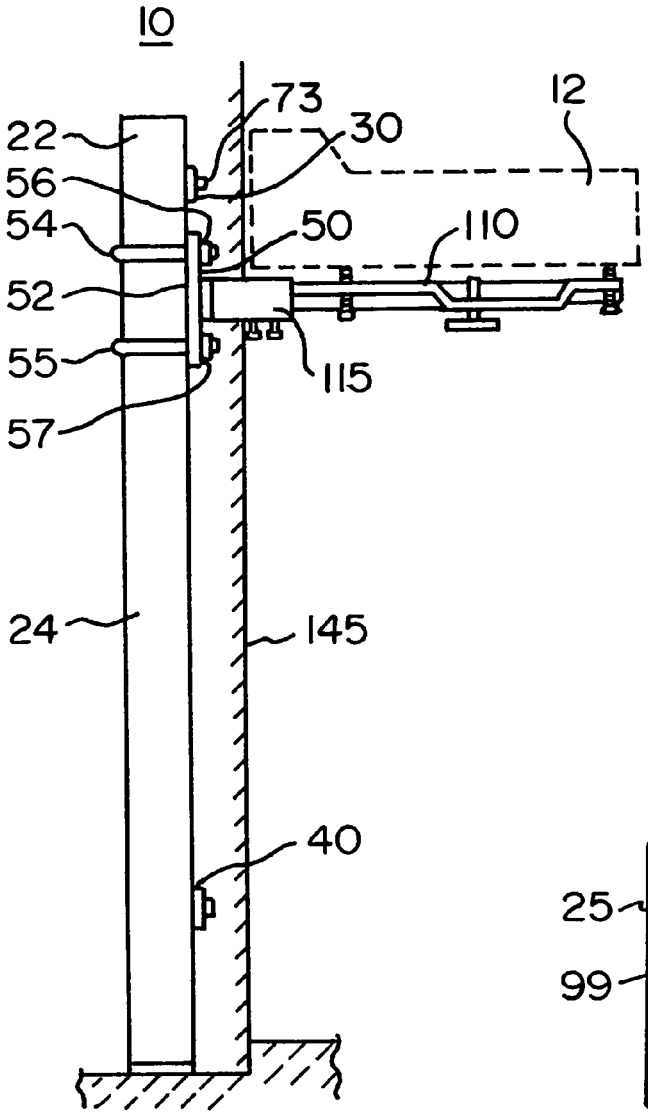
FIG. 2 is a side view from the left side of the fixture carrier illustrated in FIG. 1.
Figure 3:
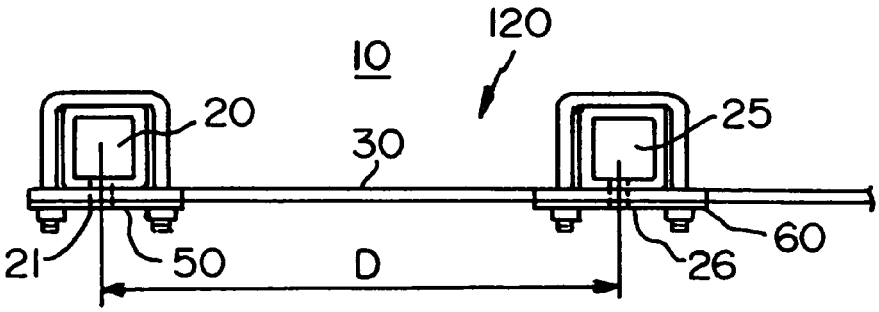
FIG. 3 is a top view of the fixture carrier illustrated in FIG. 1 with the supporting arms removed for clarity.

FIGS. 1–3 illustrate a sketch of the fixture carrier 10 in accordance with the subject invention. The fixture carrier 10 is intended to provide support to plumbing fixtures, such as china fixtures, service sinks, lavatories, urinals and water coolers. The carrier 10 includes a frame 15 having a left upright 20 and a right upright 25 spaced horizontally a distance D therefrom. The left upright 20 has a top region 22 and a bottom region 24, while the right upright 25 has a top region 27 and a bottom region 29.

A top cross bar 30 connects the top region 22 of the left upright 20 in the top region 27 of the right upright 25, thereby defining top connections 35, 36. A bottom cross bar 40 connects the bottom region 24 of the left upright 20 with the bottom region 29 of the right upright 25, thereby defining two bottom connections 45, 46. At least one top connection 36 and at least one bottom connection 46 are adjustable to permit adjustment of the horizontal distance D between the left upright 20 and the right upright 25.

A left support member, shown as left face plate 50, is mounted upon the left upright 20, while a right support member, shown as right face plate 60, is mounted to the right upright 25. Each face plate 50, 60 is vertically adjustable along its respective upright 20, 25 and, furthermore, each face plate 50, 60 is adapted to support a plumbing fixture, for example, sink 12 illustrated in phantom in FIG. 2.

Directing attention to FIG. 1, the adjustable connection 36 is comprised of a slot 70 on cross bar 30 and a fastener 73, such as a bolt, extending therethrough, slidable therein and engageable to the right upright 25 such that the fastener 73 may secure the cross bar 30 at a location along the slot 70 to position the uprights 20, 25 a desired center-to-center distance D (FIG. 3). The bottom connection 46 associated with bottom cross bar 40 may be identical to the top connection 36 associated with the top cross bar 30. A simple machine screw may act as the fastener 73 and may be secured at each connection. It should be appreciated that while a machine screw has been discussed as a fastener, it is entirely possible to utilize other fastening mechanisms such as a threaded bolt extending through an upright with a threaded nut engageably secured to the bolt on the opposite side of the upright that would permit adjustment of the frame.

Figure 1A:
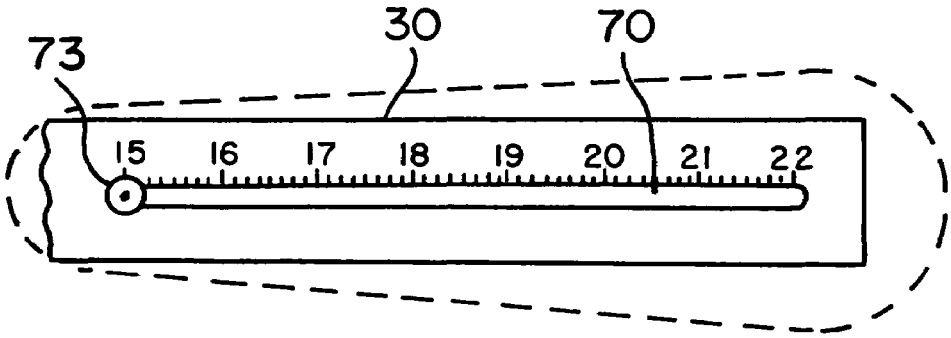
FIG. 1A is an enlarged view of the encircled portion labeled 1A in FIG. 1.

Each slot 70 may have associated with it a calibrated scale, as illustrated in FIG. 1A, so that the center-to-center distance at each cross bar 30, 40 between the uprights 20, 25 may be equal. Briefly directing attention to FIG. 1A, to make the horizontal adjustment to the top connection 36 and the bottom connection 46 uniform, the slot 70 on each of the top cross bar 30 and the bottom cross bar 40 may have calibration marks so that the left upright 20 and the right upright 25 may be spaced apart a premeasured distance. By spacing the uprights 20, 25 apart a premeasured distance, the frame 10 may be properly assembled to accept a plumbing fixture requiring supports at a fixed distance from one another.

Figure 1B:
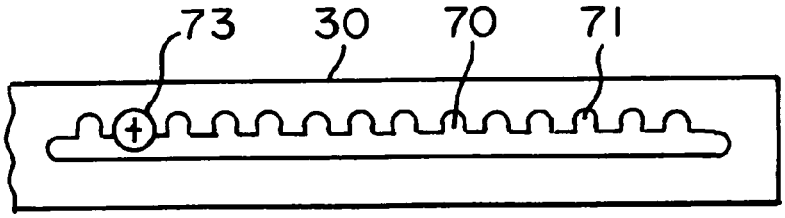
FIG. 1B is another embodiment of the encircled portion labeled 1A in FIG. 1.

As an alternate FIG. 1B illustrates the top cross bar 30 with a slot 70 having a plurality of notches 71 into which the fastener 73 may be indexed.

Figure 4:
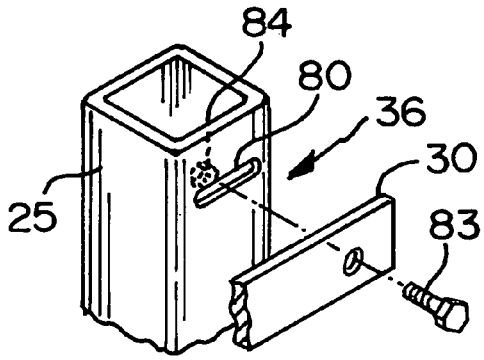
FIG. 4 is a perspective view of an embodiment whereby an upright has a lateral slot for receiving a cross bar thereby providing lateral adjustment.

Directing attention to FIG. 4, the adjustable top connection 36 may include a slot 80 within the right upright 25 and a fastener 83, such as a bolt, extending therethrough and slidably engaged therein and engageable with one end of the top cross bar 30 at a location along the slot 80 to provide a predetermined center-to-center distance D (FIG. 3) between the left upright 20 and the right upright 25. In the configuration illustrated in FIG. 4, it would be necessary to utilize a nut 84 on the opposing side of the slot 80 to engage a bolt fastener 83. Additionally, just as the slot 70 in FIG. 1B has notches 71, so too may the slot 80 in FIG. 4.

Figure 5:
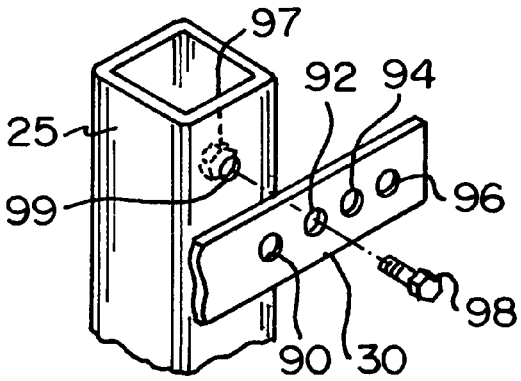
FIG. 5 is a perspective view of an upright having a single hole, wherein the cross bar has multiple spaced apart holes for lateral adjustment.

Directing attention to FIG. 5, the adjustable connection may also, in the alternative, be comprised of a plurality of spaced apart holes 90, 92, 94, 96 on the top cross bar 30 and a fastener 98, such as a bolt, extending through a selected hole to engage one end of the cross bar 30 and thereafter secured to the right upright 25 at a location along the cross bar 30 to provide a predetermined center-to-center distance D between the left upright 20 and the right upright 25. The right upright 25 may have a threaded hole 99 extending therethrough or, in the alternative, a nut 97, to accept a threaded bolt fastener 98.

Figure 6:
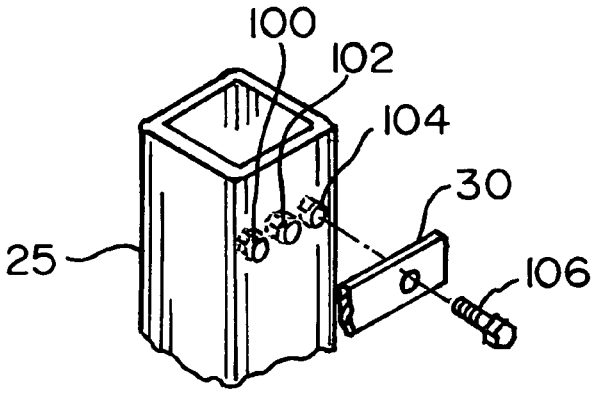
FIG. 6 is a perspective view of an upright having a plurality of laterally spaced holes to receive a cross bar for providing lateral adjustment.

FIG. 6 illustrates yet another embodiment of the adjustable connection having a plurality of spaced apart holes 100, 102, 104 within the right upright 25 with a fastener 106, such as a bolt, extending through a selected hole, engaging one end of the top cross bar 30 and secured to the right upright 25 at a location along the upright 25 to provide a predetermined center-to-center distance D between the left upright 20 and the right upright 25.

Directing attention to FIG. 2, the left face plate 50, just as the right face plate 60, is adapted to receive a supporting arm 110 which supports the fixture 12. The supporting arm 110 may be secured through an intermediate sleeve 115 which itself is secured to the left face plate 50. Each face plate, for example face plate 50, has a hole 52 extending therethrough to accept the sleeve 115. The hole 52 may be threaded and the sleeve 115 may be matably threaded. The hole 52 is preferably centered about the left upright 20 such that any load imparted through the supporting arm 110 will not produce any lateral loads upon the left face plate 50. The left face plate 50 is laterally guided on the left upright 20 and, in general, is not laterally adjustable. As illustrated in FIGS. 1–3, the face plate 50 is secured to the left upright 20 utilizing U-bolts 54, 55 extending through the face plate 50 and secured with associated pairs of nuts 56, 57. When the nuts 56, 57 are not tightened against the left face plate 50, the left face plate 50 may be vertically adjusted along the left upright 20 to a desired location. Once the face plate 50 is vertically located, it is secured to the left upright 20 by tightening the nuts 56, 57 onto U-bolts 54, 55 against the left face plate 50. The same arrangement applies to the right face plate 60 and associated U-bolts and nuts.

Figure 8A:
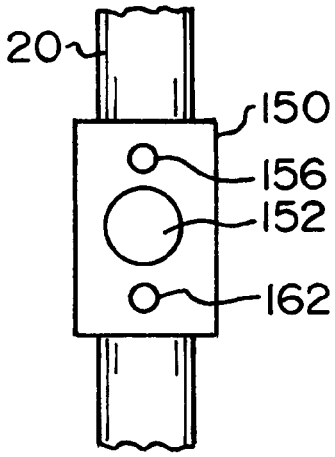
FIGS. 8A and 8B are a front view and top view of an alternate support structure.
Figure 8B:
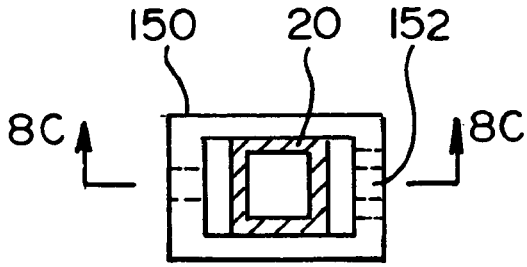
Figure 8C:
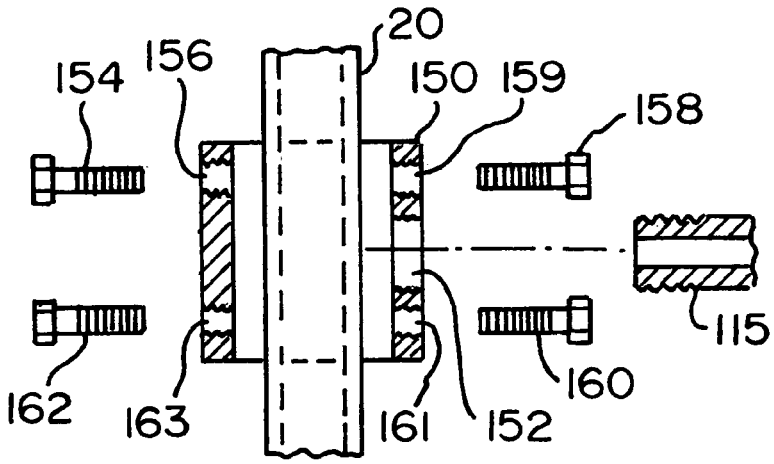
FIG. 8C is a cross-sectional view along line "8C—8C" in FIG. 8B.
Figure 2:
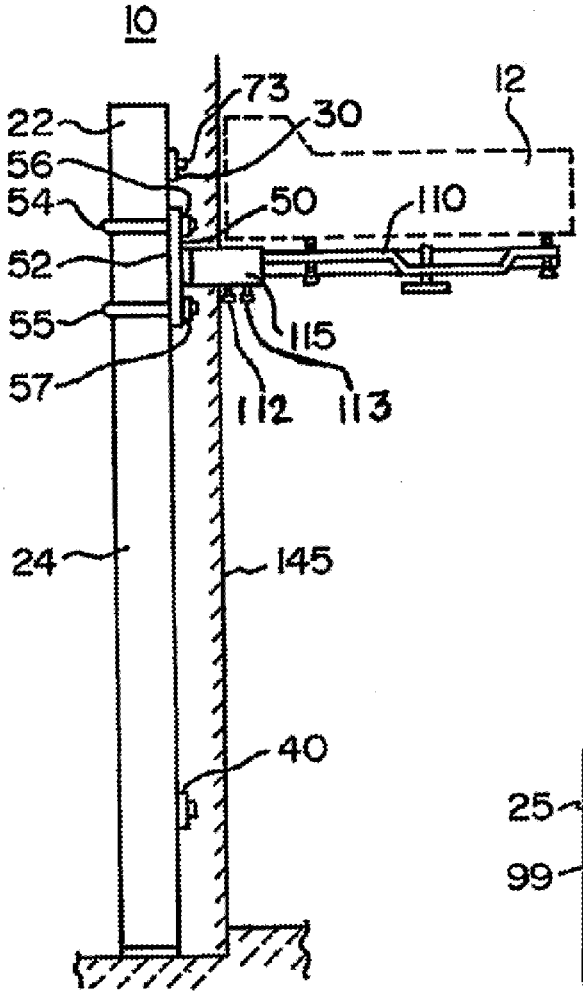
Figure 4:
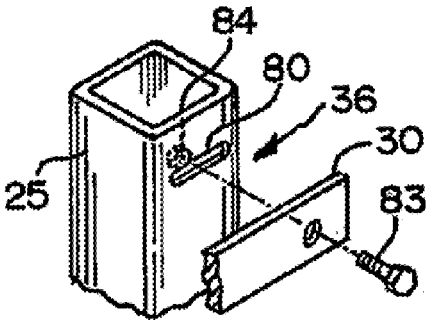
Figure 5:
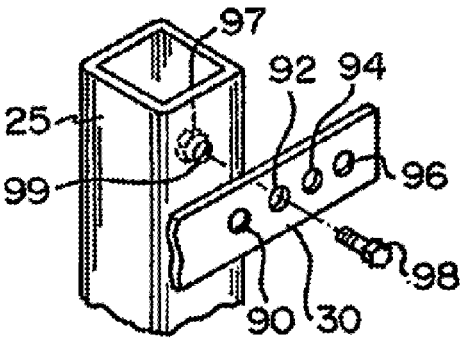
Figure 3:
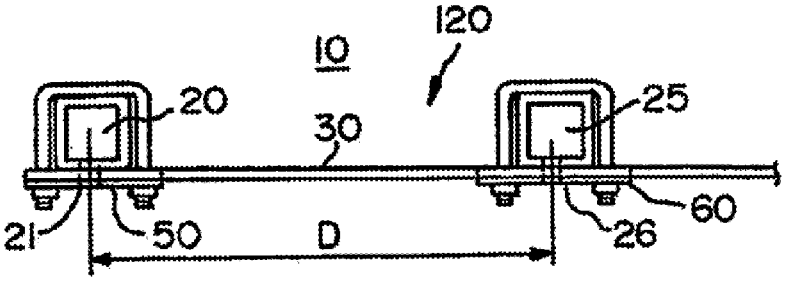

In the alternative, types of support members other than the left face plate 50 and right face plate 60 may be used. Directing attention to FIGS. 8A, 8B and 8C, a header 150 may be secured to each of the uprights 20, 25. A single header 150 is shown and is typical of a header that may be used on each upright 20, 25. Just as before, the support member, now shown as the header 150, is used to support the supporting arm 110 (FIG. 2). As illustrated in FIG. 8C, the header 150 has a hole 152 extending therethrough to accept the supporting arm 110, either directly or through an intermediate sleeve 115 (FIG. 8C). The header 150 fits over an upright 20, for example, and is secured against the upright 20 by at least one fastener 154, which may be a threaded bolt, which engages a mating hole 156 in the header 150. The fastener 154 is advanced until it firmly contacts the upright 20 so that the force of the fastener 154 against the upright 20 prevents the header 150 from moving relative to the upright 20. Additional fasteners 158, 160 and 162 may be engaged in mating holes 159, 161 and 163 to provide additional support and to permit adjustment of the header 150 upon the upright 20.

In general, such support members 50, 150 are made from cast iron and include a passageway that receives the uprights 20, 25. The support members 50, 150 are held in place by a fastener that co-acts with the uprights 20, 25. While two different types of support members 50, 150 have been described, other adjustable designs may be available to accomplish similar tasks.

FIG. 3 illustrates that each upright 20, 25 may have a rectangular cross section with a hollow center. Each upright 20, 25 may have other shaped cross-sections, such as circular, triangular or I-beam, for example. Furthermore, the uprights 20, 25 may not be hollow. The top cross bar 30 is flat and mounted to the front side 21, 26 of each upright 20, 25 to define a volume 120 behind the top cross bar 30 and between each upright 20, 25 through which conduit or piping associated with the fixture may pass.

Returning to FIG. 1, connected to the bottom portion of each upright is a flange. For example, the bottom portion 24 of the left upright 20 has attached thereto a flange 125 while the bottom portion 29 of the right upright 25 has attached thereto a flange 130. Each flange 125, 130 may be secured to the bottom portions by welding but, furthermore, each flange 125, 130 has at least one aperture 126, 131 extending therethrough to receive fasteners (not shown) for securing the fixture carrier 10 to a floor.

Figure 7:
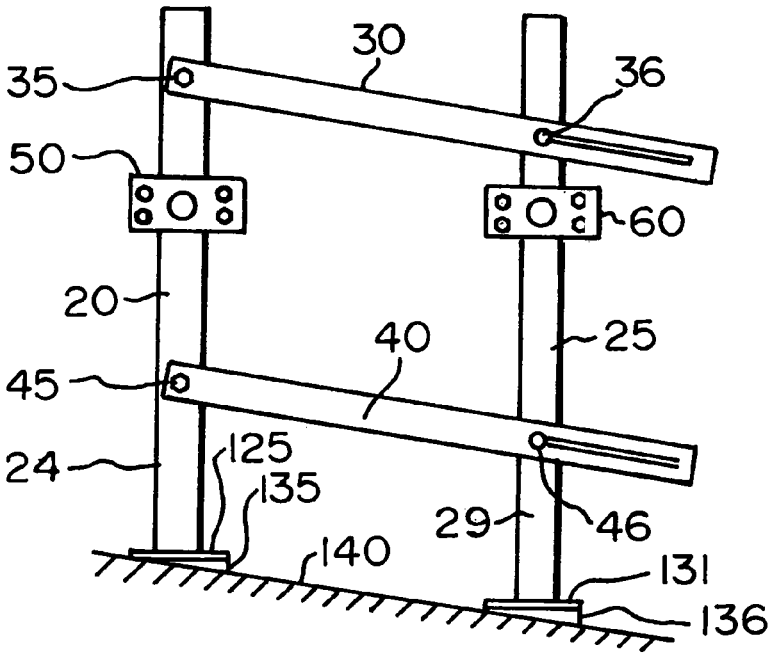
FIG. 7 is a front view of the fixture carrier used to accommodate a sloping floor.

Because each of the connections 35, 36, 45, 46 are made using releasable fasteners, such as releasably threaded bolts, it is possible to adjust the entire fixture carrier 10 to accommodate a sloped floor. In particular, directing attention to FIG. 7, the uprights 20, 25 and the cross bars 30, 40 form a parallelogram with pivotable connections 35, 36, 45, 46 such that the frame 15 may be rotated for the bottom portions 24, 29 to accommodate a sloped floor. The vertical positions of each of the left face plate 50 and right face plate 60 may then be adjusted to their desired vertical position. Shims 135, 136 may be positioned beneath each flange 125, 131, respectively, thereby permitting each upright to maintain its vertical orientation.

As illustrated in FIG. 2, the fixture carrier 10 may be mounted behind a wall 145 such that only the sleeves 115 extend through apertures within the wall 40. The arms 110 are locked within the sleeves 115 with locking screws 112, 113.

The fixture carrier 10 may be shipped to the field as a factory-assembled product with all the components assembled with the exception of the sleeve 115 and the supply arm 110. The fixture carrier 10 may be set up quickly by adjusting the horizontal distance D between each upright 20, 25 and securing each of the top connections 35, 36 and bottom connections 45, 46. Thereafter, the vertical position of each of the left face plate 50 and the right face plate 60 may be selected and the U-bolts 54, 55 and pairs of nuts 56, 57 for the left face plate 50 and the similar hardware for the right face plate 60 may be tightened to secure each face plate in the appropriate vertical position. At that time, each flange 125, 130 may be secured to the floor and the supporting arm 110 may be secured to left face plate 50 and the right face plate 60 with, if necessary, the use of a sleeve 115.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A fixture carrier for supporting plumbing fixtures, wherein the carrier comprises:

a) a frame having i) a left upright and a right upright spaced horizontally a distance therefrom, wherein each upright has a top region and a bottom region;

ii) a top cross bar connecting the top regions of each upright thereby defining top connections and a bottom cross bar connecting the bottom regions of each upright thereby defining bottom connections, wherein at least one top connection and at least one bottom connection are adjustable to permit adjustment of the horizontal distance between uprights; and b) a left support member mounted to the left upright and a right support member mounted to the right upright, wherein each support member is vertically adjustable along an upright and wherein each support member is adapted to support a plumbing fixture.

2. The carrier in accordance with claim 1, wherein the adjustable connections each comprise a slot on one of either a cross bar or an upright and a fastener extending therethrough, slidable therein and engageable to the other of the cross bar or upright such that the fastener may secure the cross bar at a location along the slot.

3. The carrier in accordance with claim 2, wherein each slot has associated with it calibrated markings, such that the fastener may secure the cross bar at a predetermined location along the slot.

4. The carrier in accordance with claim 2, wherein each slot further includes peripheral notches defining predetermined locations for the fasteners to engage the slots.

5. The carrier in accordance with claim 1, wherein the adjustable connections comprise a plurality of spaced apart holes on a cross bar and a fastener extending through a selected one and engageable to the upright such that the fastener may secure the cross bar at a location along the cross bar.

6. The carrier in accordance with claim 1, wherein the adjustable connections comprise a plurality of spaced apart holes on an upright and a fastener extending through a selected hole, engaging one end of a cross bar and secured to the upright at a location along the upright.

7. The carrier in accordance with claim 1, wherein each support member is adapted to receive a supporting arm associated with a plumbing fixture.

8. The carrier in accordance with claim 7, wherein each support member has a hole extending therethrough to accept a supporting arm and the hole is centered about the upright.

9. The carrier in accordance with claim 8, wherein the support member holes are threaded to accept threaded supporting arms.

10. The carrier in accordance with claim 1, wherein each support member is laterally fixed upon an upright and not laterally adjustable.

11. The carrier in accordance with claim 10, wherein each support member is a face plate secured to an upright by a U-bolt.

12. The carrier in accordance with claim 10, wherein each support member is a header surrounding an upright and secured thereto by fasteners engaging the header and urged against the upright.

13. The carrier in accordance with claim 1, wherein each upright has a rectangular cross-section with a hollow center, each cross bar is flat and mounted to the same side of each upright to define a volume behind each cross bar and between each upright through which conduit or piping may pass.

14. The carrier in accordance with claim 1, wherein each upright has a solid cross-section.

15. The carrier in accordance with claim 1, wherein the uprights and the cross bars of the frame form a parallelogram with pivotable connections such that the frame may be rotated for the bottom portions of each upright to accommodate a sloped floor.

16. The carrier in accordance with claim 15, wherein the pivotal connections are secured by removable fasteners.

17. The carrier in accordance with claim 1, wherein each upright has a flange attached to the bottom portion for providing a base for mounting the uprights to a floor.

18. The carrier in accordance with claim 17, wherein the flange is welded to the bottom portion on each upright.

19. A fixture carrier for supporting plumbing fixtures, wherein the carrier is comprised of:

a) a frame having i) a left upright and a right upright spaced horizontally a distance therefrom, wherein each upright has a top region and a bottom region;

ii) a top cross bar connecting the top regions of each upright thereby defining top connections and a bottom cross bar connecting the bottom regions of each upright thereby defining bottom connections, wherein at least one top connection and at least one bottom connection are adjustable to permit adjustment of the horizontal distance between uprights and wherein the adjustable connections comprise a slot on a cross bar and a fastener extending therethrough, slidable therein and engageable to the upright such that the fastener may secure the cross bar at a location along the slot; and b) a left support member mounted to the left upright and a right support member mounted to the right upright, wherein each support member is vertically adjustable along an upright and wherein each support member is adapted to support a plumbing fixture, wherein each support member has a hole extending therethrough to accept a supporting arm associated with a plumbing fixture and wherein the hole is centered about the upright.

20. The carrier in accordance with claim 19, wherein the adjustable connections each comprise a slot on one of either a cross bar or an upright and a fastener extending therethrough, slidable therein and engageable to the other of the cross bar or upright such that the fastener may secure the cross bar at a location along the slot and wherein each slot has associated with it calibrated markings, such that the fastener may secure the cross bar at a premeasured location along the slot.

21. A method of assembling a fixture carrier for supporting plumbing fixtures, wherein the carrier has a frame made up of a left upright and a right upright, wherein each upright has a top region and a bottom region, wherein the carrier further has a top cross bar and a bottom cross bar and wherein the top cross bar is adjustably connected at one end to the top region of one upright and connected at the other end to the top region of the other upright and wherein the bottom cross bar is adjustably connected at one end to the bottom region of one upright and connected at the other end to the bottom region of the other upright, the method comprising the steps of:

a) positioning one upright a predetermined distance from the other upright;

b) securing each adjustable connection to fix the uprights at the predetermined distance;

c) securing a support member at a predetermined distance along each upright; and d) mounting upon each support member a supporting arm extending from the support member adapted to support the plumbing fixture.

* * * * *

UNITED STATES PATENT AND TRADEMARK OFFICE

CERTIFICATE OF CORRECTION

PATENT NO. : 7,096,520 B2
APPLICATION NO. : 10/811477
DATED : August 29, 2006
INVENTOR(S) : Nicolia et al.

It is certified that error appears in the above-identified patent and that said Letters Patent is hereby corrected as shown below:

Drawings
Substitute Sheet 3 of the patent drawings with the attached replacement drawing sheet containing a corrected FIG. 2. The new FIG. 2 added element Nos. 112 and 113.

Signed and Sealed this

Twenty-seventh Day of February, 2007

JON W. DUDAS
*Director of the United States Patent and Trademark Office*